United States Patent [19]

Nelson

[11] Patent Number: 4,562,674

[45] Date of Patent: Jan. 7, 1986

[54] REPLACEABLE FOAM INSULATION SYSTEM

[76] Inventor: Richard C. Nelson, 31 Sunrise Crescent, Pointe Claire, Quebec, Canada

[21] Appl. No.: 435,063

[22] Filed: Oct. 18, 1982

[51] Int. Cl.[4] ..... E04B 1/76

[52] U.S. Cl. ..... 52/171; 52/404

[58] Field of Search ..... 52/404, 741, 171

[56] References Cited

U.S. PATENT DOCUMENTS

| | | | |
|---|---|---|---|
| 3,672,184 | 6/1972 | Zeilon | 62/324 |
| 3,830,309 | 8/1974 | Ray | 169/65 |
| 4,074,482 | 2/1978 | Klahr | 52/171 |

FOREIGN PATENT DOCUMENTS

| | | |
|---|---|---|
| 842252 | 5/1970 | Canada . |
| 847937 | 7/1970 | Canada . |
| 850049 | 8/1970 | Canada . |
| 915647 | 11/1972 | Canada . |
| 918026 | 1/1973 | Canada . |
| 983441 | 2/1976 | Canada . |
| 995630 | 8/1976 | Canada . |
| 1043070 | 11/1978 | Canada . |
| 1105283 | 7/1981 | Canada . |

*Primary Examiner*—Donald G. Kelly
*Assistant Examiner*—Michael Safavi
*Attorney, Agent, or Firm*—Larson and Taylor

[57] ABSTRACT

A replaceable foam insulation system is disclosed for a cavity in walls or a roof of a building structure. The system is sealed to ensure foam does not escape through vents from the cavity and can be easily destroyed without leaving a residue in the cavity. The system comprises at least one enclosed recirculating substantially horizontal passage within the cavity, means for recirculating air or gas through the passage in the cavity, and foam producing means in the passage positioned immediately downstream of the means for recirculating air or gas, the foam producing means and means for recirculating air or gas when operating together providing foam to substantially fill the passage in the cavity, and the means for recirculating air or gas when operating alone, destroying substantially all the foam in the passage.

17 Claims, 8 Drawing Figures

REPLACEABLE FOAM INSULATION SYSTEM

This invention relates to a replaceable foam insulation system for a building structure. More specifically, there is disclosed a system for generating foam for a cavity in a wall or roof of a building structure, including the cavity formed between double glazings permitting transmission of solar energy therethrough. By the term "glazing" is meant not only glass but any flexible or rigid sheet, membrane or film material that permits the transmission of solar energy therethrough.

Many buildings and structures have large areas of glazing to permit solar heat gain and light into a building during the day. Such solar heat gain can reduce heating cost. An example of such buildings are greehouses and the like which require both heat and light from the sun inside the building. One problem with such buildings is the loss of heat that occurs during night time, because the necessity of having transparent or translucent panels in a roof or wall of a building reduces the insulation properties of the building.

One way of overcoming this problem is to have a double glazing with a cavity between two glass or othertransparent glazings. Such a system allows air to be circulated within the cavity and this can avoid loss of heat in the building. An example of such a building structure is shown in my co-pending application, U.S. Ser. No. 152,809 filed May 23, 1980, which provides two layers of flexible sheets with a cavity therebetween.

It has been suggested that if the cavities between double glazings in a wall or roof be filled with foam during night time, then this foam has good insulation properties and thus greatly reduces the heat loss through the glazings during this period. Furthermore, the foam may be retained in the cavities during extremely cold days in winter. In the past it has been difficult to fill cavities with foam for a few hours and then destroy the foam to leave the cavities completely clear. Either the foam is an almost permanent foam and is difficult to destroy, or the foam has a short life and dissolves into a liquid in a short time. Furthermore, many foams leave a deposit or a coating on the inside of the glazings enclosing the cavities. The replaceable foam for the insulation system is a dispersion of gas in a foam producing liquid.

Two types of foam producing liquids have been suggested for providing foam to fill a cavity in a wall or roof. A detergent based foam and a protein based foam. Detergent foams are not very stable and generally last less than one hour. Protein foams on the other hand have much greater stability and last for several hours, however, the problems with protein foams is that they are difficult to destroy or disperse and thus are not easily removed in the morning, when the warmth and light from the sun is required in the building.

In the past foam systems for insulating wall or roof cavities have generally included a generator outside the cavity and vents located at the extremities of the cavity so that the foam is pushed into the cavity and then flows through the cavity to the extremities where the vents are located. Generally, air flows out of vents at the extremities of the cavity, but problems often occur because these vents tend to allow foam to escape as well as air, thus a wastage of foam can occur and also a difficulty arises in disposing of any escaping foam. Furthermore, uneven flow of foam in the cavity can result in pockets of air persisting in the cavity while, at the same time, foam is escaping from the vents. Another problem that exists with foams is that when a foam is generated, it often has an uneven consistency and this can result in the foam dissolving in patches, thus forming voids in the insulation. If inadequate drainage facilities exist, then when the foam dissolves, it forms a wet foamy liquid which destroys the foam around the liquid leaving puddles or areas of collapsed foam in the cavity. This problem is more pronounced with the less stable types of foams. Also when the cavity is refilled this foamy liquid tends to remain in the same position making only partial refilling possible. Thus, in past use the first cycle of foam generation produces a high quality of insulation with subsequent regenerations and fillings of the cavities being less and less effective during the regeneration cycles required through the night.

Previous methods have not provided any good means of removing the old foam residue from the cavity before injecting new foam into a cavity. Also, since it is desirable to conserve the foam producing liquid, previous systems retained the heavy, wet, collapsed foam, in the cavity until the foam could dissipate, and the resulting liquid drain away, otherwise the foam could be lost out of the vents.

The present invention provides a cavity in a wall or roof of a building structure with a recirculating enclosed passage therein so that no venting takes place from the cavity. A fan or air circulating means is provided to circulate air or gas in a substantially laminar flow within the passage, and immediately downstream of the fan is a foam generator so that foam is generated and blown from the fan around the passage. When the foam is blown around the passage and passes through the fan it is destroyed and new foam is generated from the foam generator. In this way one can constantly generate foam and circulate it around the passage. After one circulation a process of foam destruction and regeneration is established. The enclosed recirculating passage overcomes the problems of loss of foam through vents and this recirculating of air or gas and foam in a substantially laminar flow within the passage overcomes the problems of collapsing foam causing voids in the insulation.

The present invention provides a replaceable foam insulation system for a cavity in walls or roof of a building structure, the system comprising, at least one enclosed recirculating substantially horizontal passage within the cavity, means for recirculating air or gas through the passage in the cavity, and foam producing means in the passage positioned immediately downstream of the means for recirculating air or gas, the foam producing means and means for recirculating air or gas when operating together providing foam to substantially fill the passage in the cavity, and the means for recirculating air or gas when operating alone destroying substantially all the foam in the passage.

In a preferred embodiment, the means for recirculating air or gas comprises a fan positioned in the passage, such that all air or gas in the passage recirculates through the fan, the foam producing means comprises means for delivery of a foam producing liquid upon a perforated or mesh screen positioned across the passage immediately downstream of the fan. The means of delivering foam producing liquid to the screen may be by a spray or by cascading the liquid. The fan may have at leat two speeds, a first speed when used in conjunction with foam producing means and a second speed faster than the first speed when operating alone to destroy the foam. In one embodiment a liquid reservoir feed system and pump are provided to pump foam producing liquid to spray or cascade on the screen, and a drain system drains liquid from the passage back into the liquid reservoir.

In other embodiments, the passage within the cavity has a substantially rectangular cross section with an aspect ratio in the range of about 1:1 to 1:3. The recirculating passage includes two ducts side by side with connecting apertures at the two ends of the ducts. Curved deflectors are positioned in the connecting apertures at the two ends of the duct to assist in circulating foam and air or gas in the recirculating passage.

In another embodiment the means for recirculating air and the foam producing means are located in the connecting aperture at one of the two ends of the ducts or, alternatively, are located in the approximate center of one of the two ducts. In another embodiment wherein the passages are reasonably long, then at least two separate units for recirculating air and producing foam are provided, one unit located in the approximate center of each of the two ducts, or in the connecting apertures at the two ends of the ducts.

In a still further embodiment, the recirculating passage extends substantially horizontally around cavities in outside walls of the building structure, and the means for recirculating air or gas and the foam producing means comprise a plurality of separate units, the units spaced substantially evenly apart in the recirculating passage in the outside walls of the building structure. In one embodiment there may be a plurality of recirculating passages in the form of tiers one on top of the other around the building structure. In yet another embodiment the passage within the cavity has a substantially circular cross section.

The present invention also provides a process for generating foam and destroying foam in an enclosed recirculating substantially horizontal passage, comprising the steps of, positioning a fan to recirculate air or gas in the passage, delivering a foam producing liquid onto a mesh screen in the passage immediately downstream of the fan to produce foam, recirculating foam by means of the fan to fill the passage with foam, and stop delivering the foam producing liquid and maintain recirculating air or gas in the passage by means of the fan so substantially all the foam is destroyed as it passes through the fan. In other embodiments the foam producing liquid is a mixture of a liquid detergent concentrate and water. The fan recirculates the air or gas to provide a substantially laminar flow in the passage. In yet another embodiment foam producing liquid is sprayed through non-foam producing orifices into the passage to aid in destroying the foam and removing residues. In a still further embodiment a gas having a lower heat transfer than air is recirculated in the passage. The step of recirculating foam by means of the fan may be carried out intermittently.

In drawings which illustrate embodiments of the invention,

Figure 1:
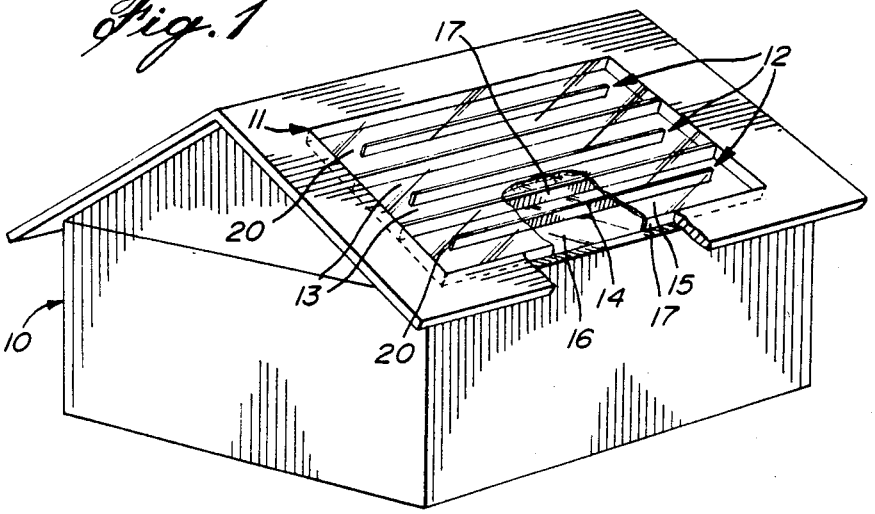
FIG. 1 is an isometric schematic view of a building having cavities in the roof containing recirculating passages for foam.

Referring now to FIG. 1, a building 10 is shown which has a double glazed sky light area 11 in a slope of the roof. The sky light area 11 comprises three separate cavities 12, each cavity having two ducts 13 which are joined together at each end to form a recirculating passage, and have a central partition 14 dividing the ducts. The flow of air or gas in the ducts 13 is substantially a horizontal flow, although the slope of the roof does require a change in elevation at the ends of the ducts.

Each duct has a top glazing 15 and a bottom glazing 16 supported by the central partition 14 and side partitions 17 which separate cavities 12 one from the other. The partitions 14,17, may be structural members and form part of the building structure, or may be quite independent of the building structure. In one embodiment the duct has only an outside or top glazing 15.

Figure 2:
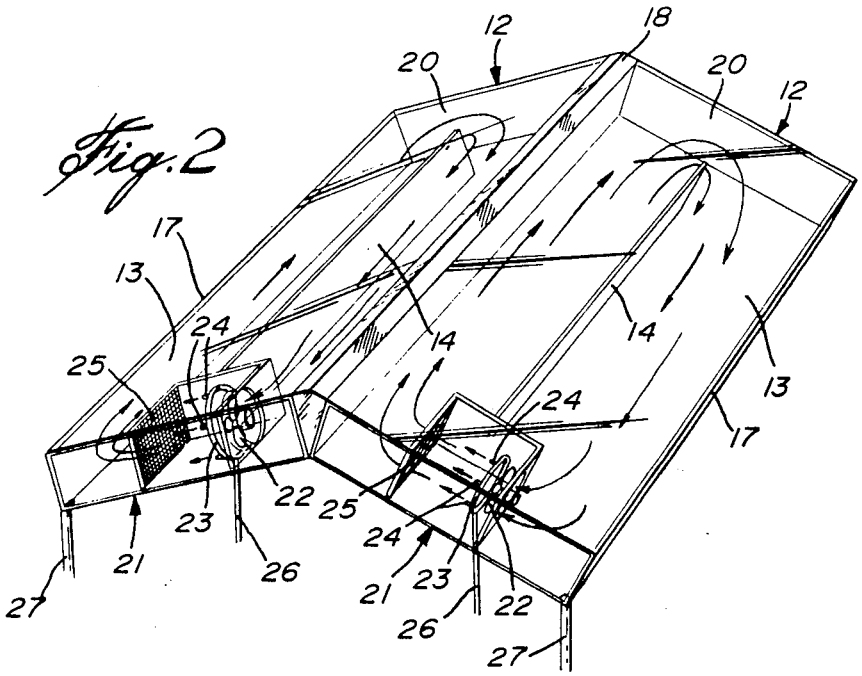
FIG. 2 is an isometric schematic view of two roof cavities each having a recirculating passage therein containing a fan and foam generator.

FIG. 2 illustrates two separate cavities 12 which are sloped upwards to form a peak 18. The sloped cavities 12 still allow substantially horizontal air or gas flow in the ducts 13. The sloped roof configuration conveys rain off the roof, and permits liquid in the ducts to drain to one corner making drainage a simple matter. An example of such a configuration is shown in my copending patent application U.S. Ser. No. 152,809.

The replaceable foam insulation system is disclosed in FIG. 2. Each duct 13 has a substantially rectangular cross section. The ducts have a substantially horizontal flow of air or gas transversely across the sloped roof. At one end of the ducts is a connecting aperture 20 and at the other end is a combination fan and foam generator unit 21. Arrows illustrate the recirculating flow that occurs within the two ducts 13, the aperture 20 and the generator unit 21.

The combination fan and foam generator unit 21 comprises a fan 22 and immediately downstream of the fan 22 is a ring 23 having spray nozzles 24 therein, the spray nozzles direct spray onto a wire mesh or perforated screen 25 which extends across the cross sectional area of the aperture so that all the circulating air or gas and foam recirculating in the passage must pass through the fan 22 and the wire mesh screen 25. A feed line 26 feeds foam producing liquid to the spray nozzles 24. Drain lines 27 shown at the lowest corners of the ducts 13 drain any liquid from the ducts into a reservoir (not shown). Typically, the fan 22 is a multi-vane tube axial type. The vanes are provided with pitch adjustment so that the velocity and/or flow rate can be set. In another embodiment a two speed fan can be provided, one speed being the higher speed for blowing air or gas through the ducts 13 and the second speed being a slower speed used for the generation of foam. The flow of both air or gas and foam in the ducts 13 is substantially horizontal. If the flow is vertical then it is often found that foam is not distributed evenly throughout the passage 12, furthermore, the foam structure at the bottom may be destroyed from the weight of the head of foam in a vertical passage.

The spray nozzles shown in the figures may be replaced by a cascade or curtain of foam producing liquid down the screen 25, which may be a fibrous screen or a spongy porous screen that holds the liquid. The screen remains wet during the time that foam is being produced and air or gas is blown through the screen from the fan forming foam bubbles on the downstream side of the screen which leave the screen and are forced through the ducts 13. The replaceable foam for the insulation system is a dispersion of air or gas in a foam producing liquid.

The enclosed recirculating passage preferably contains air, however, it is a sealed circuit and the air always remains in the system. The air can be replaced with a gas, preferably one which has lower heat transfer properties than air, such as argon or carbon dioxide. Such a gas improves the insulating properties of the roof or wall of the building structure.

Figure 3:
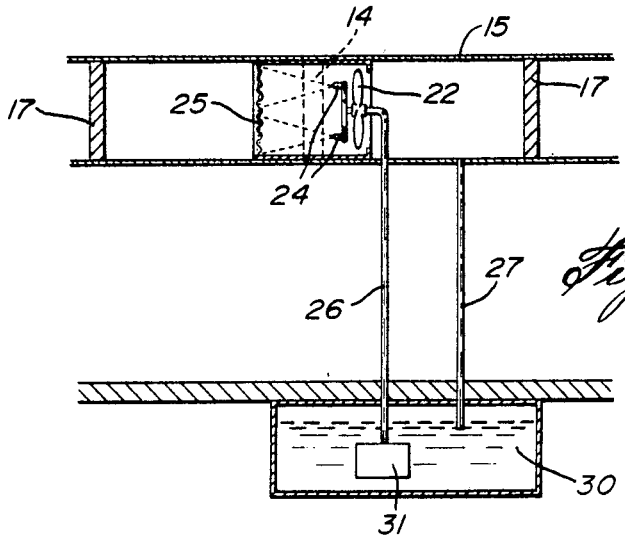
FIG. 3 is a partial sectional elevation showing a fan and foam generator with a reservoir and foam producing liquid pump beneath.

The type of foam preferred for use in the present invention is a detergent based foam in foam producing liquid form, stored in a reservoir 30, as shown in FIG. 3. The reservoir 30 is preferably kept beneath the floor of the building, and a high pressure pump 31 pumps the foam producing liquid through the feed pipe 26 to nozzles 24. The drain line 27 allows the liquid produced from the collapsed foam to drain into the reservoir 30 for regeneration.

A typical detergent based foam concentrate is sodium lauryl sulfate which is a fatty acid foam, alternatively, a fluoro-chemical foam concentrate may be used. A preferred foam producing liquid is 3% by weight sodium lauryl sulfate concentrate and 97% by weight water. In operation, the high pressure pump 31 pumps the foam producing liquid to deliver the foam producing liquid onto the screen 25. The fan 22 blows foam which is produced on the downstream side of the screen 25 into the first duct 13 pushing the air in front of the foam so the foam slowly takes up the space of the first duct 13 then flows through the aperture 20 and fills up the second duct 13 so the complete recirculating passage is filled with foam. As the foam is continuously generated it eventually completes the circuit and then passes through the fan 22. The fan breaks up the foam immediately and any liquid produced from the collapsed foam drains back to the reservoir 30. If there is a gradual degeneration of the foam in the ducts 13 then liquid produced from the collapsed foam also drains back to the reservoir 30.

It is found that the foam generally lasts for one to two hours before collapsing, thus the flow speed of the foam in the recirculating passage is preferably set so that a complete circuit of the foam takes less than the life of the foam. The foam generation occurs all the time the passage is to be filled with foam to avoid the foam collapsing in some areas, and if collapsing does occur the voids are filled up by new foam being generated and pushed through the passage. In some instances, if the anticipated life of the foam is longer than the time required to fill the passage, then the fan and foam generator operate together on an intermittent time cycle. During the operating periods, the foam is generated and flows to make at least one complete recirculation so as to ensure all the foam in the passage is renewed. Between operating cycles, the foam is stationary in the passage. The time duration between operating cycles is sufficiently short to ensure the foam does not collapse to form voids in the passage. This duration is dependent upon the stability of the particular foam used in the system.

To destroy the foam in the system, the foam producing liquid and water being delivered to the screen 25 is turned off. The fan destroys the foam, and any liquid is allowed to drain away. The fan then forces air or gas into the first duct 13 and around the passage 12 forcing the foam around the circuit and through the fan 24 where it is destroyed. To assist in this destruction of foam, foam producing liquid may be sprayed through non-foam orifices preferably provided in the ducts 13 to destroy foam remaining in the ducts and to wash away any deposits left by the collapsed foam. The destroyed foam turns to liquid and drains away through drain lines 27. When foam is required in the passage, the fan is started and foam producing liquid is delivered to the screen 25. In the destruction of foam, a higher volume of air is preferably circulated in the passage 12. This is achieved by increasing fan speed or, alternatively, by a variable pitch vane on the fan to vary the air flow therethrough.

Figure 4:
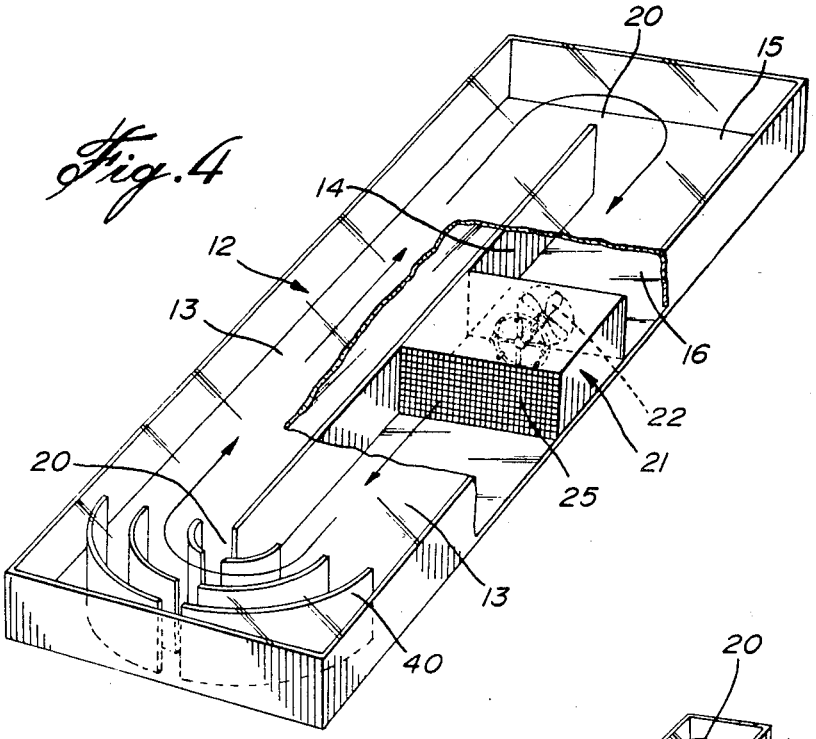
FIG. 4 is an isometric schematic view of a recirculating passage in a cavity with curved deflectors at one end to assist in the circulation of air or gas and foam and a fan and foam generator at the center of one of the ducts.

An example of a passage 12 with two ducts 13 is illustrated in FIG. 4. Both ducts 14 are on substantially the same plane. The fan and foam generator unit 21 is positioned in the center of one duct 14 with special curved deflectors 40 at each end in connecting apertures 20 in the center partition 14. The deflectors 40 provide a laminar flow for the air or gas and foam flowing through the apertures 20. Turning vanes and other devices may also be used to provide a smooth non turbulent flow for the change of direction. The sides of the ducts 13 are preferably formed of slippery surfaces or have finishes on the insides to allow easy movement of the foam, and the foams themselves preferably exhibit low adhesion and cohesion. The flow, both air or gas flow and foam flow, in the ducts 13 is preferably laminar flow with a minimum of turbulence at the surfaces of the ducts.

Figure 5:
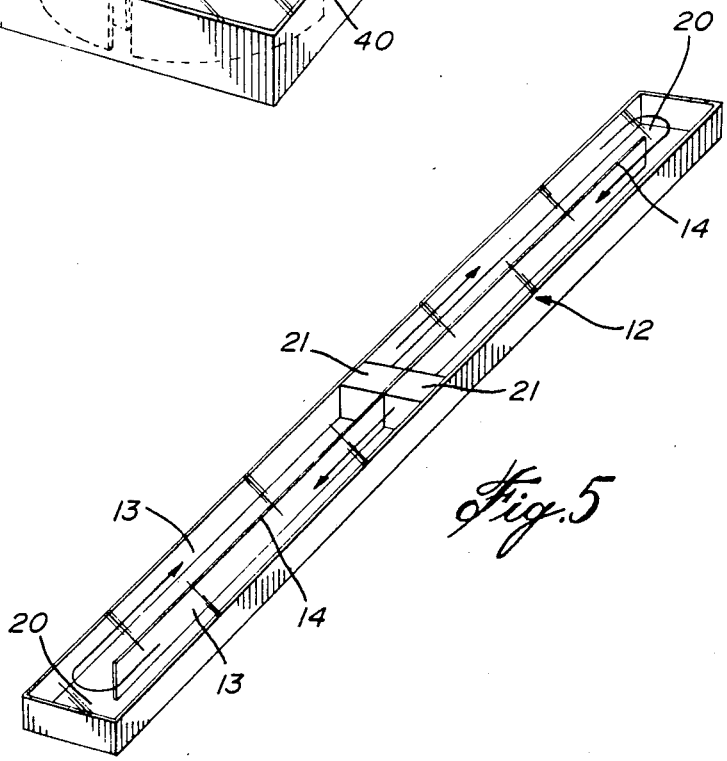
FIG. 5 is an isometric schematic view of a cavity with a recirculating passage containing two ducts, each duct having a fan and foam generator at the approximate center.

FIG. 5 illustrates a further embodiment having extra long ducts with two fan and foam generator units 21 located at the centers of each duct. Whereas the units 21 are shown in the center of each duct, they could also be provided at the ends of the ducts depending upon the building structure.

Figure 6:
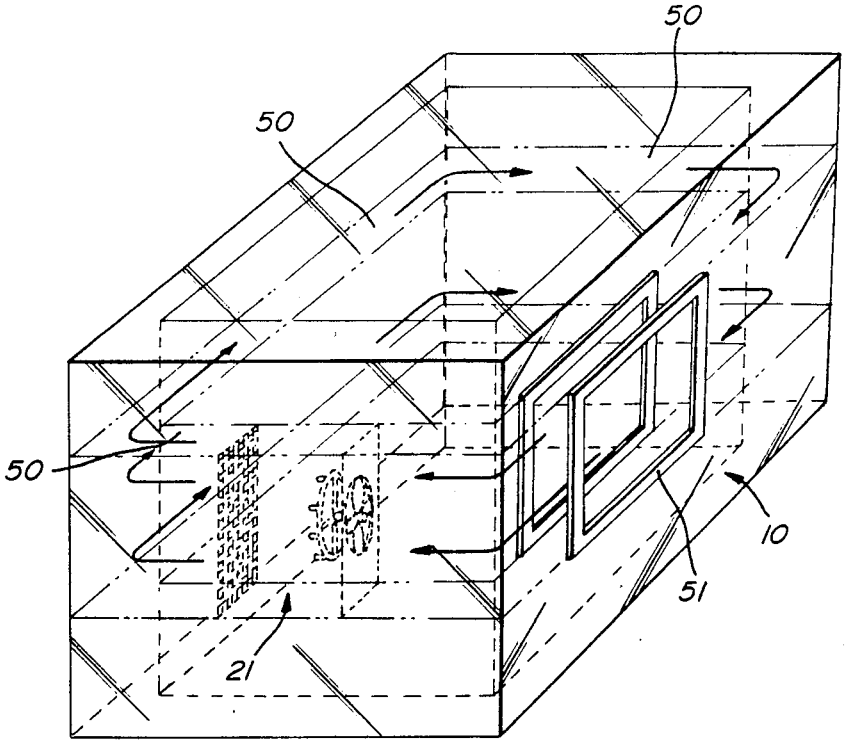
FIG. 6 is an isometric schematic view of a cavity with a recirculating passage extending around the outside walls of a building.

A building structure 10 is shown in FIG. 6 with a cavity in the form of a horizontal enclosed passage 50 extending completely around the walls. The passage 50 has windows 51 on one or more sides which are double glazed and allow foam to fill the passage 50 and the windows 51 to insulate the walls and window areas. In another embodiment the passage 50 is the cavity between the glazings which extends completely around the walls of the building structure. A fan and foam generator unit 21 is shown positioned in one wall of the passage. If the building is large, several units 21 may be provided in the passage.

In another embodiment of wall cavities, the passages 50 may be formed in tiers, one on top of the other. This allows foam to be kept in all but one tier on cold days. Furthermore, tiers avoid high passages and allows the aspect ratio of the cross section of the passages to be kept in the preferred range of 1:1 to 1:3. The dimensions of the passage or duct are such that the height of the duct does not have a head of foam therein sufficient to cause the foam at the bottom to collapse. The weight of the foam must not compress the lower portion of foam so as to leave voids at the top of the passage. Each passage preferably has guides at the corners to ensure laminar flow throughout the passage.

Figure 7:
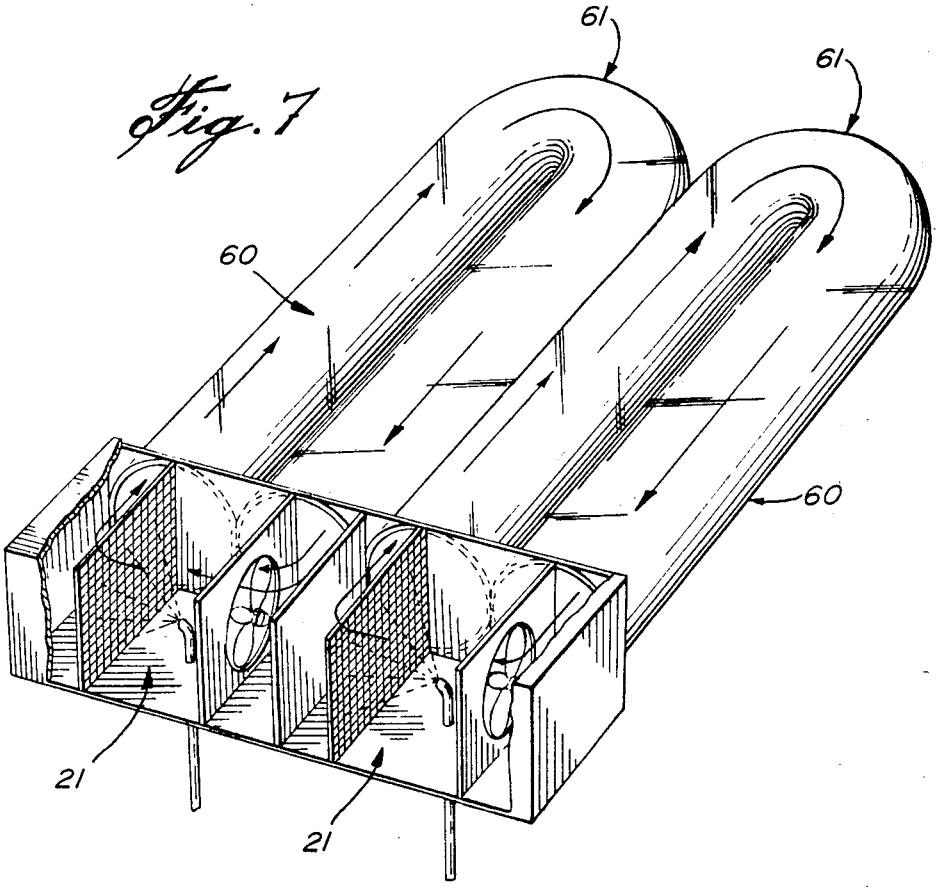
FIG. 7 is an isometric schematic view of two roof cavities with the passages formed of substantially round tubes.
Figure 8:
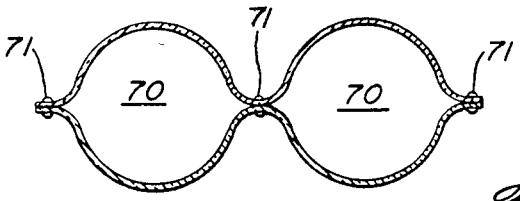
FIG. 8 is a cross sectional view of two lens shaped passages of a cavity.

Another embodiment of the system is illustrated in FIG. 7 where the passages 60 are formed of round ducts, preferably a clear plastic film tube. The ducts touch each other and are preferably stuck together to ensure there is no leakage. A U-turn portion 61 is provided at the ends of the duct, providing laminar flow, and the open ends of the duct are attached to a fan and foam generator unit 21. In another embodiment shown in FIG. 8 the ducts 70 are formed from a flexible film joined at three positions 71 to provide a lens shaped cross section. Such a system allows a great many ducts 70 to be made out of two film sheets. In the system shown in both FIGS. 7 and 8 a positive pressure is desired in the ducts.

It has been found that the system of the present invention is applicable to portable buildings, because the foam can easily be generated and destroyed thus avoiding the necessity of carrying insulation in batts or sheets. In portable buildings there is no need to have the cavities with glazings on one side. Portable buildings with non-transparent walls with cavities inbetween can benefit from improved insulation with the foam system of the present invention, and retain their portability. Structural elements of the building may be incorporated into the cavity system. The partitions 14 and 17 may be structural members of the building. The panels may be formed of glass, membrane, film or plastic sheet, either transparent or translucent. As disclosed in my previous application, manifolds may be incorporated at each end wherein the air or gas circulating within the duct is heated, cooled or humidified, as required.

Various changes may be made to the scope of the present invention which is limited only by the following claims.

The embodiments of the invention in which an exclusive property or privilege is claimed, are defined as follows:

1. A replaceable foam insulation system for a cavity in walls or a roof of a building structure, the system comprising, divider wall means within the system forming at least one enclosed substantially horizontal continuous recirculating passageway within the cavity, a fan disposed within said passageway for recirculating gas through said passageway, mesh screen means disposed downstream of said fan, said mesh screen means including foam producing means for providing foam to substantially fill the continuous passageway in the cavity when operative together with said fan and said fan, when operative alone, destroying substantially all the recirculated foam, said recirculated foam passing along said continuous passageway from downstream of the fan through said continuous passageway and upstream of the fan to pass through said fan.

2. The process according to claim 1 wherein the means for producing foam producing liquid comprises at least one spray nozzle with means for pumping foam producing liquid through the spray nozzle.

3. The process according to claim 1 wherein the means for producing foam producing liquid comprises a means for cascading a foam producing liquid down the screen.

4. The system according to claim 1 wherein the fan has at least two speeds, a first speed when used in conjunction with a foam producing means, and a second speed faster than the first speed, when operating alone to destroy the foam.

5. The system according to claim 1 wherein the passageway within the cavity has a substantially rectangular cross section with an aspect ratio in the range of about 1:1 to 1:3.

6. The system according to claim 2 including a liquid reservoir, feed system and pump to pump foam producing liquid through at least one spray nozzle, and a drain system to drain liquid from the passage back into the liquid reservoir.

7. The system according to claim 1 wherein the recirculating passageway includes two ducts, side by side, with connecting apertures at the two ends of the ducts.

8. The system according to claim 7 wherein curved deflectors are positioned in the connecting apertures at the two ends of the ducts to assist in circulating foam and air or gas in the recirculating passage.

9. The system according to claim 7 wherein the fan and the foam producing means are located in the connecting aperture at one of the two ends of the ducts.

10. The system according to claim 7 wherein the fan and the foam producing means are located in the approximate center of one of the two ducts.

11. The system according to claim 7 wherein the fan and the foam producing means comprises at least two separate units, each unit spaced substantially equally apart in the recirculating passage.

12. The system according to claim 1 wherein the recirculating passage extends substantially horizontally around cavities in outside walls of the building structure.

13. The system according to claim 12 wherein a plurality of recirculating passages in the form of tiers one on top of the other extend substantially horizontally around the building structure.

14. The system according to claim 13 wherein the fan and the foam producing means in each of the recirculating passages comprise a plurality of separate units, the units spaced substantially evenly apart in each of the recirculating passages in the building structure.

15. The system according to claim 1 wherein the passage within the cavity has a substantially circular cross section.

16. The system according to claim 1 wherein the cavity has an outside glazing.

17. The system according to claim 1 wherein the cavity has an outside glazing and an inside glazing.

* * * * *